US009695741B2

(12) United States Patent
Mueller

(10) Patent No.: US 9,695,741 B2
(45) Date of Patent: Jul. 4, 2017

(54) INTERNAL COMBUSTION ENGINE

(71) Applicant: Kevin M. Mueller, Rockton, IL (US)

(72) Inventor: Kevin M. Mueller, Rockton, IL (US)

( * ) Notice: Subject to any disclaimer, the term of this patent is extended or adjusted under 35 U.S.C. 154(b) by 144 days.

(21) Appl. No.: 14/822,589

(22) Filed: Aug. 10, 2015

(65) Prior Publication Data

US 2016/0047300 A1 Feb. 18, 2016

(51) Int. Cl.

| | |
|---|---|
| ***F02B 59/00*** | (2006.01) |
| ***F02B 71/00*** | (2006.01) |
| ***F02B 75/28*** | (2006.01) |
| ***F02B 75/02*** | (2006.01) |

(52) U.S. Cl.

CPC ..... *F02B 59/00* (2013.01); *F02B 75/02* (2013.01); *F02B 2075/025* (2013.01); *F02B 2075/027* (2013.01)

(58) Field of Classification Search

CPC .... F02B 59/00; F02B 75/02; F02B 2075/027; F02B 2075/025

USPC ..... 123/42, 46 SC, 50 R, 50 A, 50 B, 204, 123/238, 232, 248

See application file for complete search history.

(56) References Cited

U.S. PATENT DOCUMENTS

| | | |
|---|---|---|
| 7,721,687 B1 | 5/2010 | Lockshaw et al. |
| 8,161,924 B1 | 4/2012 | Lockshaw et al. |

OTHER PUBLICATIONS

RCV Engines Limited; "Technology: Rotating Cylinder Valve"; internet printout; date last visited Nov. 10, 2015; 1 page; http://www.rcvengines.com/technology_rotatingcylindervalve.html.

*Primary Examiner* — Carlos A Rivera
*Assistant Examiner* — Syed O Hasan
(74) *Attorney, Agent, or Firm* — Reinhart Boerner Van Deuren P.C.

(57) ABSTRACT

There is disclosed an internal combustion engine. The internal combustion engine includes a cylinder unit and a piston unit. The cylinder unit is rotatably coupled to a pair of spaced-apart crankshafts, with the cylinder unit moveable along a longitudinal axis. The piston unit is continually disposed within the cylinder unit, with the piston unit rotatively coupled to a second pair of spaced-apart crankshafts. The piston is moveable along the longitudinal axis in a direction opposite the direction of the cylinder during a combustion cycle. Both the cylinder unit and the piston unit are structured to be balanced relative to the respective center-of-gravity of each unit. Each center-of-gravity is located midway between the pair of spaced-apart crankshafts to which each unit is rotatively coupled.

21 Claims, 15 Drawing Sheets

INTERNAL COMBUSTION ENGINE

CROSS-REFERENCE TO RELATED PATENT APPLICATIONS

This patent application claims the benefit of U.S. Provisional Patent Application No. 62/037,201, filed Aug. 14, 2014, and U.S. Provisional Patent Application No. 62/055,319, filed Sep. 25, 2014, the entire teachings and disclosures of which are incorporated herein by reference thereto.

FIELD OF THE INVENTION

This application relates generally to internal combustion engines, and more particularly to an engine that simulates reciprocation between a piston and cylinder moving in opposite directions along a horizontal axis.

BACKGROUND OF THE INVENTION

In commercial internal combustion engines, typically a piston moves in a stationary cylinder. It is also known that some internal combustion engines have a moving piston and cylinder, but in these engines the piston and cylinder completely separate during a portion of the combustion cycle. However, in the above described engines, energy is lost due to side loading of the cylinder which results in wear of the piston and cylinder. In the engine with separated piston and cylinder precise alignment must be maintained during a combustion cycle which increases the costs and complexity of the engine. As such, there is a need in the art for combustion engine that addresses the above drawbacks.

The invention provides such a combustion engine. These and other advantages of the invention, as well as additional inventive features, will be apparent from the description of the invention provided herein.

BRIEF SUMMARY OF THE INVENTION

The disadvantages and limitations of the background art discussed above are overcome by the present disclosure.

There is disclosed an internal combustion engine. The internal combustion engine includes a cylinder unit and a piston unit.

The cylinder unit is rotatively coupled to a pair of spaced-apart crankshafts, with the cylinder unit moveable along a longitudinal axis.

The piston unit is continually disposed within the cylinder unit, with the piston unit rotatively coupled to a second pair of spaced-apart crankshafts. The piston is moveable along the longitudinal axis in a direction opposite the direction of the cylinder during a combustion cycle. Both the cylinder unit and the piston unit are structured to be balanced relative to the respective center-of-gravity of each unit. Each center-of-gravity is located midway between the pair of spaced-apart crankshafts to which each unit is rotatively coupled.

The cylinder unit includes a hollow cylinder rotatably coupled to a pair of spaced-apart crankshafts with each crankshaft defining a bore receiving a locating pin coupled to the cylinder unit. The locating pins are aligned on the same horizontal plane but offset from one another, with the cylinder unit movable along a longitudinal axis. The cylinder unit further includes a sleeve valve, including a cap liner and a beveled pinion gear keyed to one of the crankshafts and is in operative engagement with a ring gear coupled to the sleeve valve and rotatably coupled to the cylinder. One locating pin of the pair is coupled to the hollow cylinder and another locating pin of the pair is coupled to the cap liner of the sleeve valve.

The piston unit is continually disposed within the cylinder unit, with the piston unit rotatably coupled to a second pair of spaced-apart crankshafts. Each crankshaft defines a bore receiving a locating pin coupled to the piston unit, with the locating pin aligned on the same horizontal plane but offset from one another. The piston is movable along the longitudinal axis in a direction opposite the direction of the cylinder unit, with both the cylinder unit and the piston unit configured to be balanced relative to the respective center of gravity of each unit. Each center of gravity is located midway between the pair of spaced-apart crankshafts to which each unit is rotatably coupled.

In one embodiment, the hollow cylinder wall defines a pair of oval ports. The oval ports are in line with one another and are 45 degrees apart. The oval ports are configured to selectively align with a single oval port defined in the sleeve valve. In one embodiment, the single oval port defined in the sleeve valve and the pair of oval ports defined in the cylinder wall are the same width and each of the three ovals are aligned at the same longitudinal position along the longitudinal axis of the cylinder. A cylinder cap is structured to enclose a portion of the hollow cylinder and the sleeve valve, with the cylinder cap coupled to a cylinder housing enclosing another portion of the hollow cylinder. The cylinder cap further defines two oval-shaped orifices located to align with the pair of oval ports defined in the hollow cylinder.

In one embodiment, of the internal combustion engine, the ring gear is twice the diameter of the pinion gear with the gear teeth defined in each gear engaging and rotating the sleeve valve in a fixed relationship with the cylinder unit.

During a cycle of the internal combustion engine, the movement of the piston unit and the cylinder unit along the longitudinal axis simulates reciprocal motion of the two units and maintains a constant velocity.

The internal combustion engine further includes a fuel supply system coupled to the cylinder unit and an ignition system coupled to the piston unit, with each system coupled to an electronic control unit.

The combustion of fuel in the internal combustion engine is facilitated by a fuel igniter disposed in one of the cylinder unit and the piston unit, with the fuel igniter structured to ignite fuel in the cylinder at a pre-determined time.

In the disclosed internal combustion engine, the fuel is one of natural gas, diesel fuel, and gasoline. The fuel igniter in the disclosed internal combustion engine, is one of a coil and a spark plug.

In another embodiment, the internal combustion engine can include at least one additional piston unit and an additional cylinder unit operatively coupled to the other piston unit and cylinder unit. Other embodiments may include additional cylinder units and piston units operatively coupled together and sharing selective gear trains to structure a multi-cylinder engine.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings:

FIGS. 4-11 illustrate, schematically, the four cycle motion of the piston unit and cylinder unit of the internal combustion engine illustrated in FIG. 1, with:

FIG. 4 illustrating the start of an intake stroke of the units;

FIG. 5 illustrating the intake stroke;

FIG. 6 illustrating the start of a compression stroke;

FIG. 7 illustrating the compression stroke;

FIG. 8 illustrating the start of a power stroke;

FIG. 9 illustrating the power stroke;

FIG. 10 illustrating the start of an exhaust stroke;

FIG. 11 illustrating the exhaust stroke;

FIG. 12 illustrating the intake stroke;

FIG. 13 illustrating the start of a compression stroke;

FIG. 14 illustrating the compression stroke;

FIG. 15 illustrating the start of a power stroke;

FIG. 16 illustrating the power stroke;

FIG. 17 illustrating the start of an exhaust stroke;

FIG. 18 illustrating the exhaust stroke;

FIG. 19 illustrating the start of an intake stroke of the units;

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
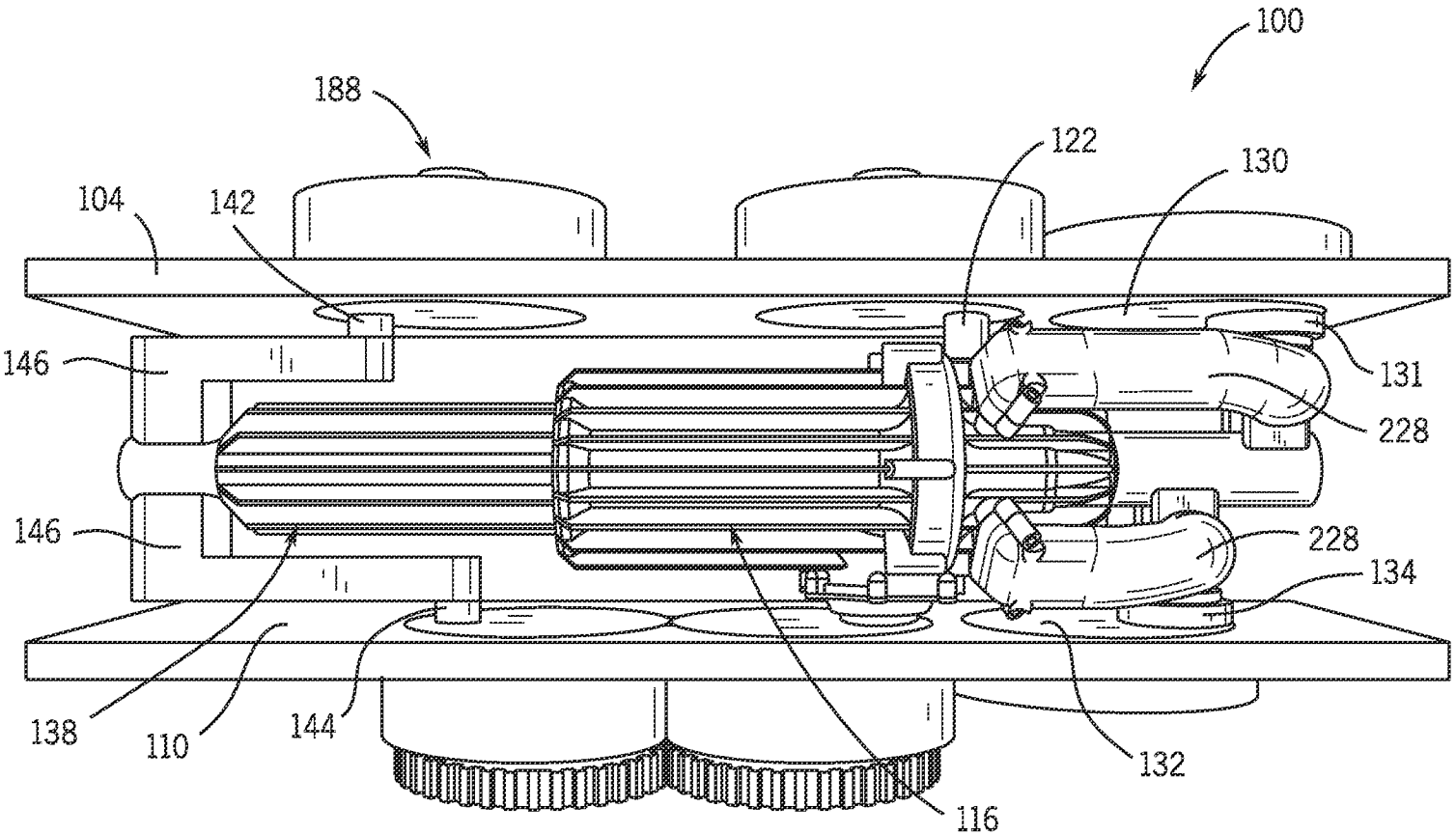
FIG. 1 is a perspective illustration of an exemplary embodiment of an internal combustion engine having a piston unit and a cylinder unit both of which move in opposite directions, relative to each other, along a horizontal axis and remain in contact throughout a combustion cycle.
Figure 2:
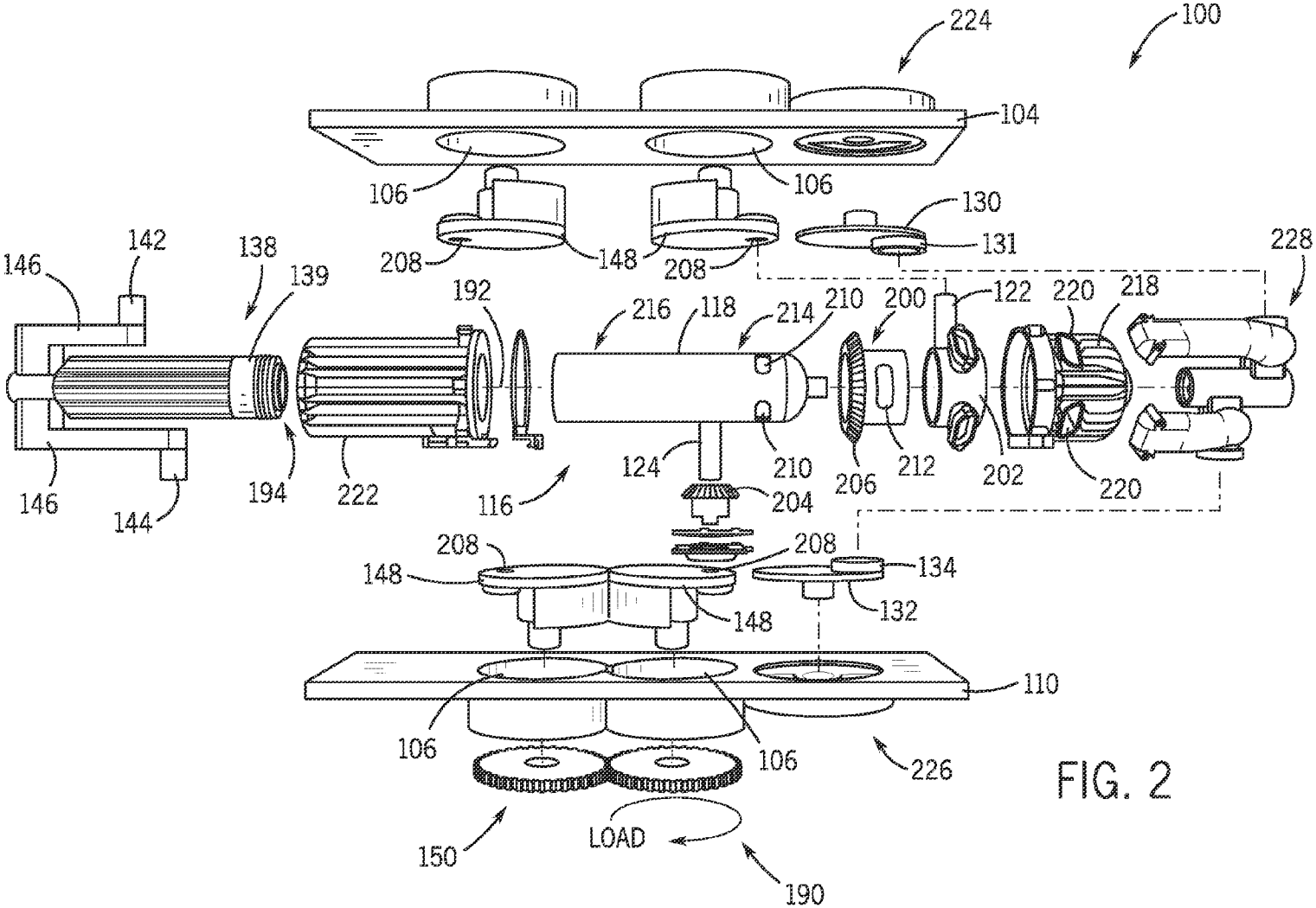
FIG. 2 is an exploded view of the internal combustion engine including a rotary sleeve valve illustrated in FIG. 1.
Figure 3:
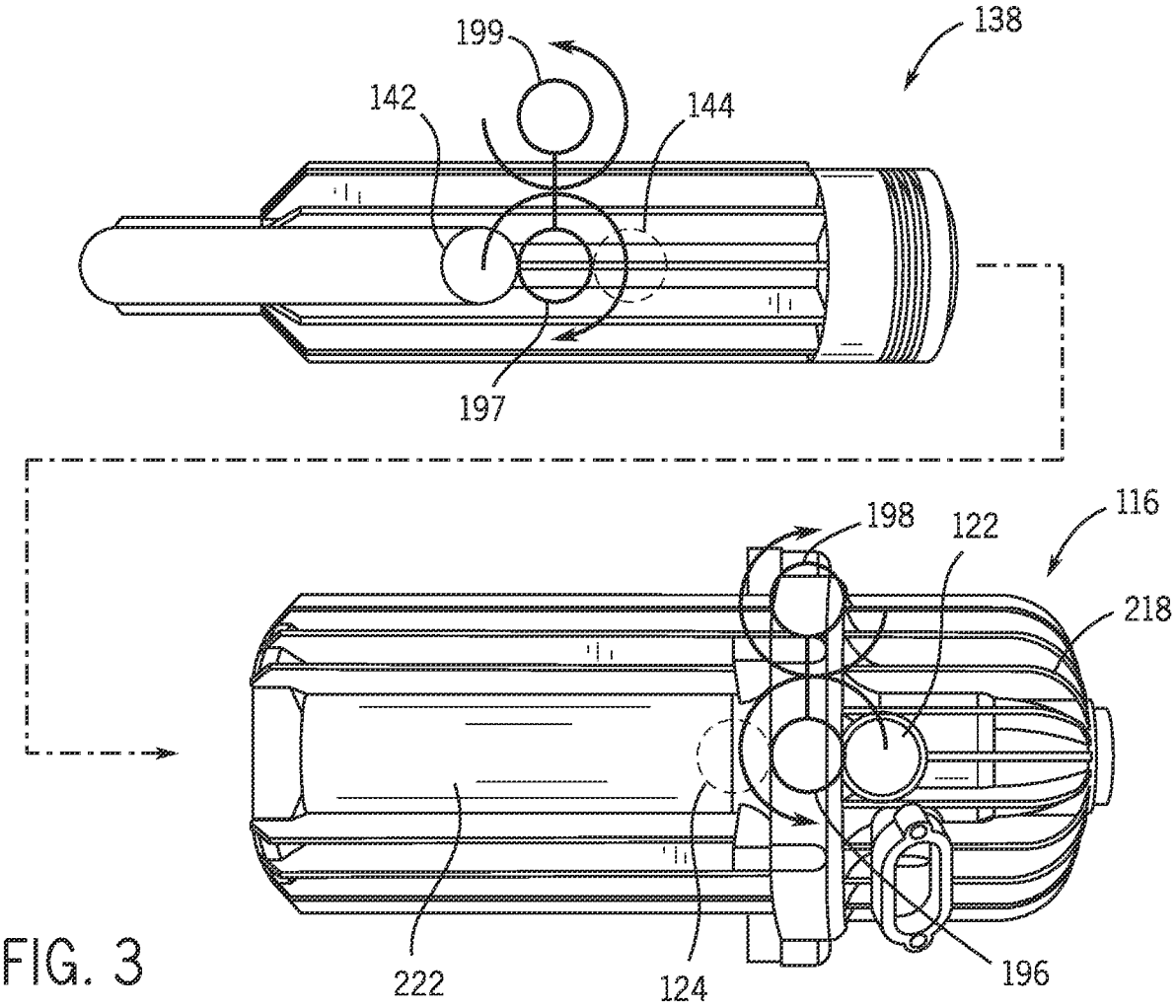
FIG. 3 is a top view of the piston unit and cylinder unit, illustrating that each unit is rotating about the respective unit's center of gravity and illustrating the rotation of each unit's center-of-gravity during a combustion cycle.

Referring to the FIGS. 1-21, there is disclosed a four-cycle internal combustion engine 100 of a modular design which features individual power units of any number that may be laid out horizontally, stacked vertically, or arranged in any combination. Each internal combustion engine 100 includes a separate piston unit 138 and cylinder unit 116 supported at two points each by separate crankshafts 148. Each crankshaft incorporates only one crank throw and is counter-weighted. There are two crankshafts 148 per unit regardless of whether the assembly is a piston unit 138 or a cylinder unit 116. Both the piston unit 138 and the cylinder unit 116 are balanced with their respective center-of-gravity 197, 196 being located midway between the two crankshaft journals on which they are supported. FIG. 1 illustrates a single four-cycle internal combustion engine 100 and includes a piston unit 138 and a cylinder unit 116. The piston unit 138 and the cylinder unit 116 are aligned along the same longitudinal axis 192 regardless of orientation.

The piston unit 138 is continually disposed within the cylinder unit 116 throughout the four-cycle combustion cycle. During the four-cycle combustion cycle, both the piston unit 138 and the cylinder unit 116 move in opposite directions relative to each other. Such movement along the longitudinal axis 192 simulates reciprocal motion of the two units and maintains a constant velocity.

Figure 20:
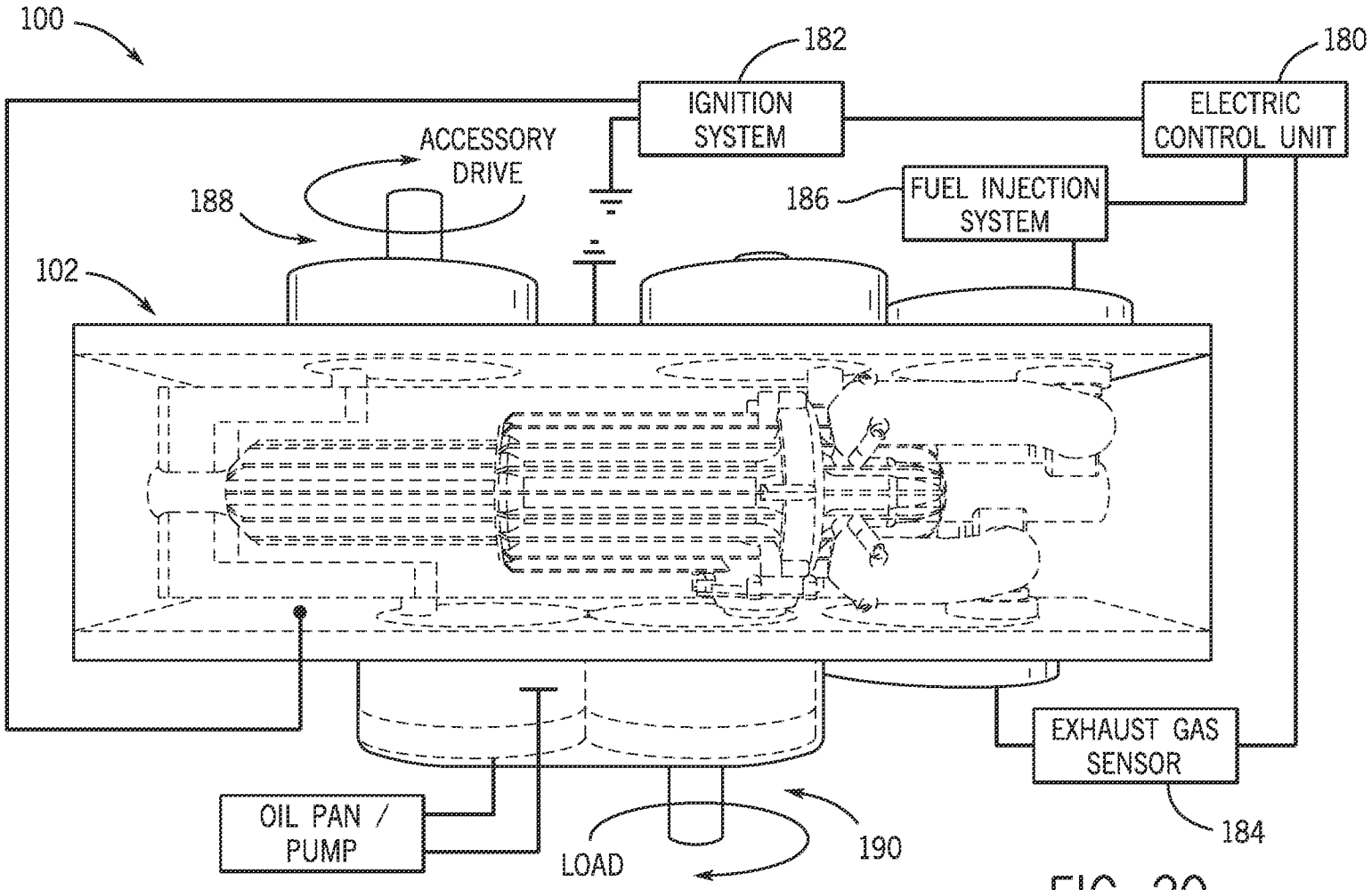
FIG. 20 is a schematic illustration of the internal combustion engine of FIG. 1 in a housing and coupled to at least an ignition system, a control unit, a fuel injection system, with the engine further coupled to a load and having an accessory drive.

As illustrated in FIGS. 1 and 20, the internal combustion engine 100 is contained within an engine housing 102. The engine housing 102 includes at least a first housing side plate 104 which defines a plurality of bores 106, 224. The engine housing 102 also includes a second housing side plate 110 which also defines a plurality of bores 106, 224. The bores defined in the side plates receive crankshafts 148, intake valve 130, and exhaust valve 132.

The cylinder unit 116 includes a hollow cylinder 118. Coupled to the cylinder is a cap liner 202 with the cap liner including a first cylinder locating pin 122. A second cylinder locating pin 124 is coupled to the hollow cylinder 118 wall. The first and second cylinder locating pins 122, 124 are located along the same horizontal plane but offset from each other.

During the four-cycle combustion cycle the pair of spaced-apart crankshafts coupled to each of the cylinder unit 116 and piston unit 138 rotate together in the same direction for a given assembly, but counter to the rotation of the other crankshafts rotation direction. To be clear, the two crankshafts 148 coupled to the piston unit 138 rotate in the same direction but opposite to the rotation of the two crankshafts 148 coupled to the cylinder unit 116. Such rotation brings the piston unit 138 and cylinder unit into opposition with one another at one point and in conjunction with each other at another point during the four-cycle combustion cycle, but the piston 139 does not completely exit from the hollow cylinder 118.

During the four-cycle combustion cycle, each of the piston unit 138 and cylinder unit 116 are rotating about their respective center-of-gravity 196, 197 with the center-of-gravity 196, 197 of each in rotation about a point dictated by the length of the crank throw. (See FIG. 3) During the complete combustion cycle (See FIGS. 4-19), the piston unit 138 appears to reciprocate within the cylinder unit 116 but the combined rotation of the two units 116, 138 about all four axes of the counter-weighted crankshafts 148 simulates reciprocation. As each of the piston unit 138 and cylinder unit 116 rotate about their respective center-of-gravity 196, 197, the combined weight of the units is shared by the locating pins 122, 124, 142, and 144 coupled to the four weighted crankshafts 148 (See FIGS. 2 and 3). Each unit, whether a piston or a cylinder, rotates about a point in space defined as a rotation center of gravity 198, 199. This rotation center of gravity is a product of the piston or cylinder unit and that unit's two crankshaft counter weights. The side to side movement of the units about such point in space illustrated in FIGS. 4-11.

As a result of the disclosed configuration the piston unit 138 and cylinder unit 116 do not give up energy by changing their respective velocities. In other words, with the simulated reciprocation of this configuration no energy is lost stopping and starting the piston as required in a conventional internal combustion engine. In addition, wear on the piston is minimized because there is no side loading on the piston, as in conventional engines.

The power generated by the combustion within the internal combustion engine 100 is transmitted directly down the center line of the piston unit 138 and cylinder unit 116 since they are both on the same longitudinal axis 192.

The internal combustion engine 100 further includes a rotary sleeve valve 200 assembly operatively coupled to the cylinder unit 116.

The structure of the disclosed internal combustion engine 100 provides power transmitted directly down the center line of the piston unit 138 and cylinder unit during the combustion cycle. Since the cylinder unit 116 acts like a piston as well as the piston unit 138 power is transmitted from the combustion explosion in both directions and acts on a greater surface area. An exemplary embodiment of the internal combustion engine 100 provides a total stroke distance of eight inches as a result of the piston unit 138 and cylinder unit 116 having four inches of movement relative to each other based on the crank throw of two inches. It should be understood, that the total stroke length can be configured for other distances based on the specific configuration of the crankshafts, piston unit 138 and cylinder unit 116 which would be understood by one ordinarily skilled in the art.

It is also found that the internal combustion engine 100 disclosed takes advantage of the ability to use a longer stroke, without any speed penalty as found in a conventional design since the total stroke is a combination of the movement of the piston unit 138 and the cylinder unit 116 which is not found in a conventional internal combustion engine 100 which only has the piston moving. The structure of the disclosed internal combustion engine 100 provides a greater efficiency by allowing for more complete burn and will produce a cooler exhaust.

As illustrated in FIGS. 2 and 4-19, during the four-cycle combustion cycle, the sleeve valve 200 opens and closes orifices 210 in the cylinder 118 (further discussed below) to allow intake and exhaust of the combustion during the combustion cycle. The rotary motion of the sleeve valve 200 is facilitated and controlled by a ring gear 206 coupled to the sleeve valve 200 and to a pinion gear 204 coupled to one of the crankshafts 148. The rotation motion of the rotary intake valve 130 and rotary exhaust valve 132, each of which is coupled to an intake/exhaust manifold 228, that is also coupled to the cylinder unit 116, is facilitated by the motion of the manifold 228. The timing of each of the rotary valves 130, 132, the single sleeve valve 200, and manifold 228, relative to the combustion cycle is facilitated by the movement of the cylinder unit 116.

The internal combustion engine 100 is housed in an appropriate housing structure 102. The engine housing 102 illustrated in FIG. 20 is a schematic illustration and it should be understood that any appropriate configuration to house the internal combustion engine 100 can be utilized as determined by a user of the internal combustion engine 100. As further illustrated in FIG. 20, a fuel injection system 186, an exhaust gas sensor 184, and an ignitions system 182 are coupled to an electronic control unit 180 all of which are coupled to the internal combustion engine 100 for monitoring and controlling the combustion cycle of the engine.

The internal combustion engine 100 can be configured to drive accessories with an accessory drive 188 coupled to the engine as well as a load 190. For example, the accessory drive 188 can be utilized to drive an alternator or air conditioner unit and the load 190 can be a set of drive wheels coupled to a vehicle structure.

The cylinder unit 116 may include a counter-weight on one end of the cylinder unit 116. The counter-weight typically is on the end of the cylinder unit which receives the similarly balanced piston unit 138. Another end of the cylinder unit 116 is coupled to the intake/exhaust manifold 228. The cylinder unit 116 includes a first cylinder locating pin 122 attached to the wall of the hollow cylinder 118 and a second cylinder locating pin 124 coupled to the cap liner 202, with each cylinder locating pin 122, 124 along the same horizontal plane but offset from each other. (See FIG. 2) Each of the cylinder locating pins 122, 124 are received in a bore 208 of a counter-weighted crankshaft 148. In a typical arrangement, the first cylinder locating pin 122 is received in a bore of the counter-weighted crankshaft 148 which is received in a bore defined in the first housing side plate 104. The second cylinder locating pin 124 is received in a bore 200 of a counter-weighted crankshaft 148 mounted in a bore defined in the second housing side plate 110 and coupled to a crankshaft gear train 150.

The piston unit 138 is structured to fit within the cylinder unit 116 throughout the entire combustion cycle of the internal combustion engine 100. One end of the piston unit 138 is operatively disposed in the cylinder unit 116. In one embodiment, a fuel igniter 194, such as a spark plug or a glow plug is mounted in the piston unit 138. It should be understood that a fuel igniter 194, alternatively, can be mounted within the cylinder unit 116 to ignite the fuel during the combustion cycle.

On another end of the piston unit 138 a pair of piston arms 146 are coupled to the piston unit 138. One end of each of the pair of pin arms 146 include one of a first piston locating pin 142 and a second piston locating pin 144. The first piston locating pin 142 is received in a bore 208 in a counter-weighted crankshaft 148 mounted in a bore in the first housing side plate 104. Such counter-weighted crankshaft 148 typically drives an accessory drive 188. The second piston locating pin 144 is received in a bore 208 in a counter-weighted crankshaft 148 which is received in a bore in the second housing side plate 110. That crankshaft is typically coupled to the crankshaft gear train 150 for a load 190 coupled to the internal combustion engine 100.

During the combustion cycle of the internal combustion engine 100, a movement of the cylinder unit 116 also moves an intake/exhaust manifold 228 coupled to the rotary intake valve 130 and rotary exhaust valve 132. The intake/exhaust manifold is received in a rotary intake valve driver 131 coupled to the rotary intake valve 130 and received in a rotary exhaust valve driver 134 coupled to the rotary exhaust valve 132. Exhaust and intake valves 130, 132 separately disposed in the housing side plates 104, 110 (see FIG. 2) are structured to provide the necessary intake and exhaust function of the combustion cycle of the internal combustion engine 100 as the rotary valves 130, 132 are moved by the motion of the cylinder unit 116 during the combustion cycle. It should be noted that during the combustion cycle the piston unit 138 and the cylinder unit 116 are never separated during the combustion cycle and move towards and away from each other during the four-cycle combustion cycle.

Internal combustion engine 100 uses a sleeve valve 200 coaxial with the hollow cylinder 118 of the cylinder unit 116. The sleeve valve 200 is structured to rotate around the hollow cylinder 118 as driven by a ring gear 206 coupled to one end of the sleeve valve 200. The sleeve valve defines an oval port 212 and is aligned with a pair of oval ports 210 defined in the hollow cylinder 118. The single oval port 212 defined in the sleeve valve 200 and the pair of oval ports 210 defined in the cylinder wall of a hollow cylinder 118 are the same width and each of the three ovals are aligned at the same longitudinal position along the longitudinal axis 192 of the hollow cylinder 118.

The ring gear 206 engages a pinion gear 204 which is rotatably mounted on the locating pin 124 coupled to the hollow cylinder 118. The pinion gear 204 and the ring gear 206 have beveled teeth configured to mesh with each other. The pinion gear 204 drives the ring gear 206 causing the sleeve valve 200 to rotate about the hollow cylinder 118. As the sleeve valve 200 rotates, the oval ports defined in the cylinder wall 118 are opened and closed during an appropriate stroke of the four-stroke combustion cycle of the internal combustion engine 100. A cap liner 202 which supports a cylinder locating pin 122 is coaxial with the sleeve valve 200 and both the cap liner 202 and the sleeve valve 200 are enclosed in a cylinder cap 218. The cylinder cap 218 in addition to enclosing the sleeve valve 200 and the cap liner 202 also encloses a portion 214 of the hollow cylinder 118. The cylinder cap 218 couples to a cylinder housing 222 which itself encloses another portion 216 of the hollow cylinder 118. Appropriate fasteners and gaskets are used to couple the cylinder cap 218 and the cylinder housing 222 together over the hollow cylinder 118.

The pinion gear 202 is keyed to a crankshaft 148 and drives the ring gear 206 through a 45 degree angle as the locating pin 124 coupled to the hollow cylinder 118 rotates about the crankshaft 148. In one embodiment, the ring gear 206 is twice the diameter of the pinion gear 204 with the gear teeth defined in each gear engaging in rotating the sleeve valve 200 in a fixed relationship with the cylinder unit 116. Such a relationship results in the sleeve valve 200 rotating once around the cylinder 118 for every two revolutions of the cylinder unit locating pin 124 around the crankshaft 148.

As the sleeve valve 200 rotates, its single oval port 212 selectively aligns with the intake port in the hollow cylinder 118 during the intake stroke of the piston 139 in the cylinder unit 116. The sleeve valve 200 continues to rotate to close off both cylinder ports 210 during the compression and power strokes while the piston unit 138 and cylinder unit's 116 relative motion carry the piston 139 back and forth within the hollow cylinder 118. The cylinder valve 200 continues its rotation to align with the exhaust port in the hollow cylinder 118 as the piston unit 138 and cylinder unit 116 oppose one another. Finally, the sleeve valve 200 closes off the exhaust port and opens the intake port to begin another combustion cycle. The reference to exhaust port and intake port described above are the two cylinder oval ports 210 illustrated in FIG. 2.

As described above, the cylinder cap 218 encloses a portion 214 of the hollow cylinder 118 covering the sleeve valve 200. In a typical configuration, the cylinder cap 218 includes a dome, which encloses and is in contact with the cylinder head of the hollow cylinder 118. A heat transfer grease may be used to fill any air gap between the hollow cylinder 118 and the cylinder cap 218. It should be noted that both the cylinder cap 218 and the cylinder housing 222 may include cooling fins to assist in heat dissipation. The cylinder cap 218 also includes oval-shaped orifices defined in the cylinder cap 218. The oval-shaped orifices 220 align with the cylinder oval ports 210 and will open and close at the same time as the ports in the cylinder 210 by rotation of the sleeve valve 200 as driven by the pinion gear 204 and ring gear 206.

The intake/exhaust manifold 228 couples with the oval-shaped orifices 220 defined in the cylinder cap 218. The intake/exhaust manifold 228 also couples with the valve drivers 131, 134 of the intake and exhaust valves 130, 132. In operation the cylinder oval ports 210, the orifices in the cap liner 202, the cylinder cap oval-shaped orifices 220, and the intake/exhaust manifold 228 will align and are opened or closed by rotation of the sleeve valve 200 during the combustion cycle of the internal combustion engine 100.

The internal combustion engine 100 disclosed herein typically includes oil galleries and pan oil pumps for lubrication. Appropriate gaskets are employed as needed as well as appropriate filters for air and fuel as would be understood by one ordinarily skilled in the art. It should also be understood that the internal combustion engine 100 can utilize fuel such as one of natural gas, diesel oil, and gasoline. Appropriate fuel injection sensors, ignition system 182 and electronic control of the internal combustion engine 100 is arranged to deal with the particular fuel being utilized.

The internal combustion engine 100 and the respective parts are composed of materials, such as steel and aluminum of sufficient strength and composition to withstand the forces to which the engine is exposed.

Figure 4:
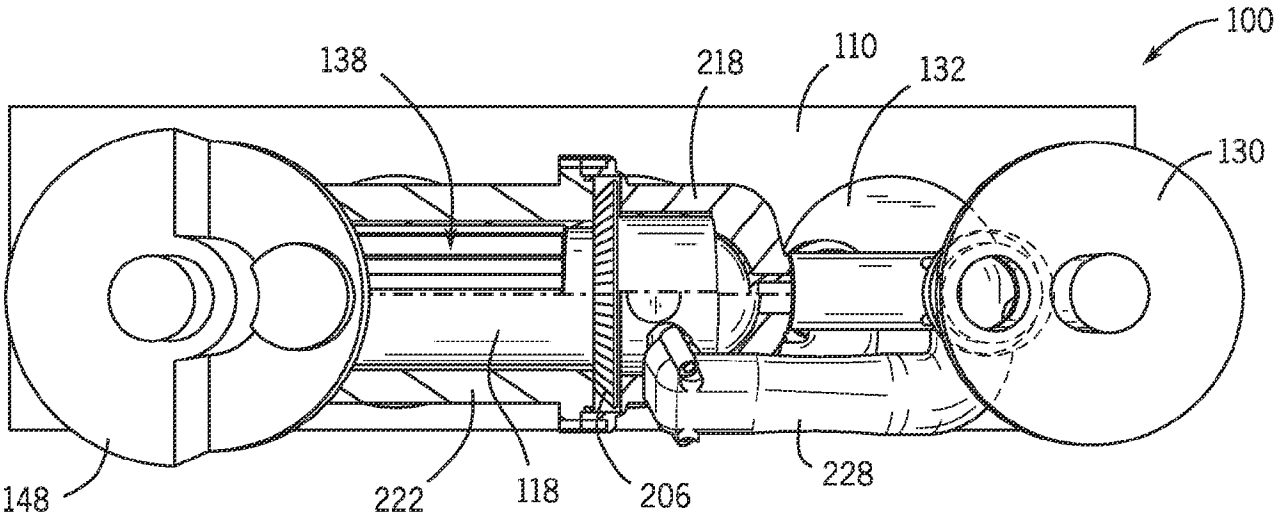
Figure 5:
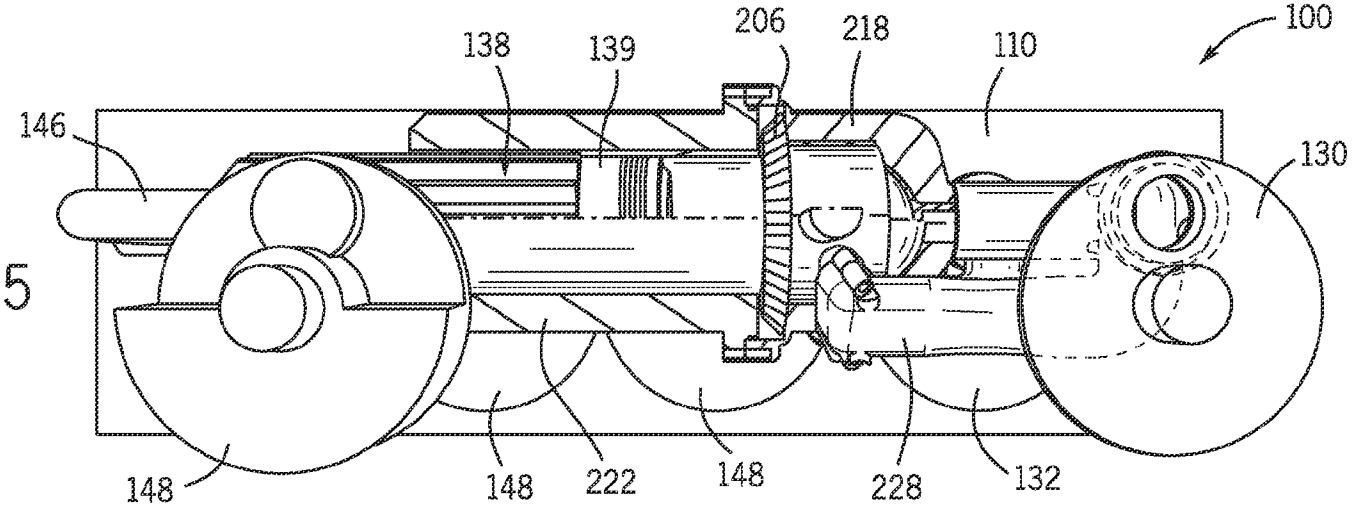
Figure 6:
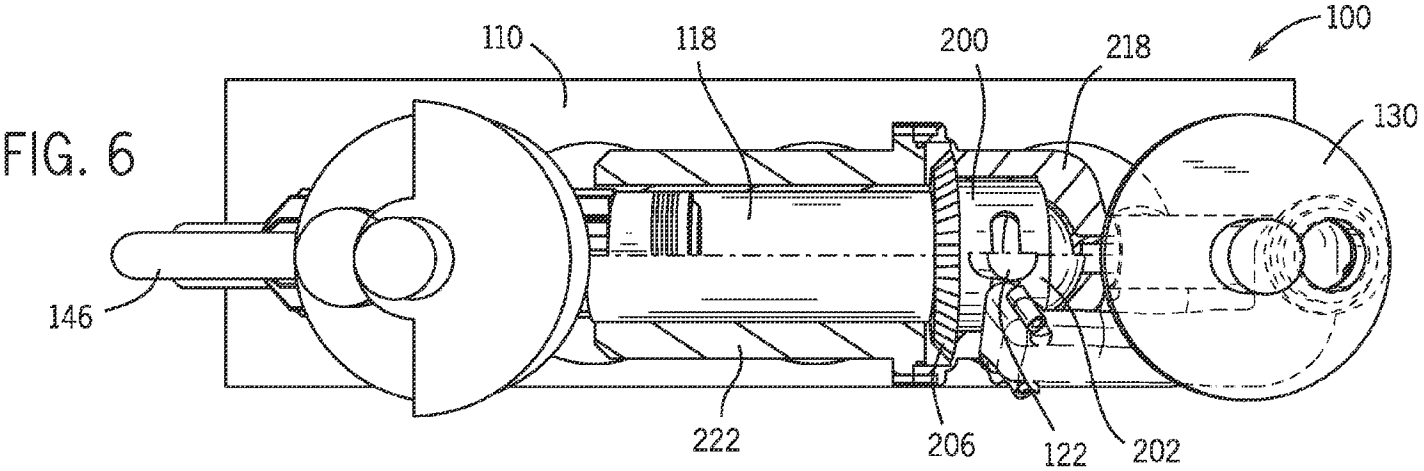
Figure 7:
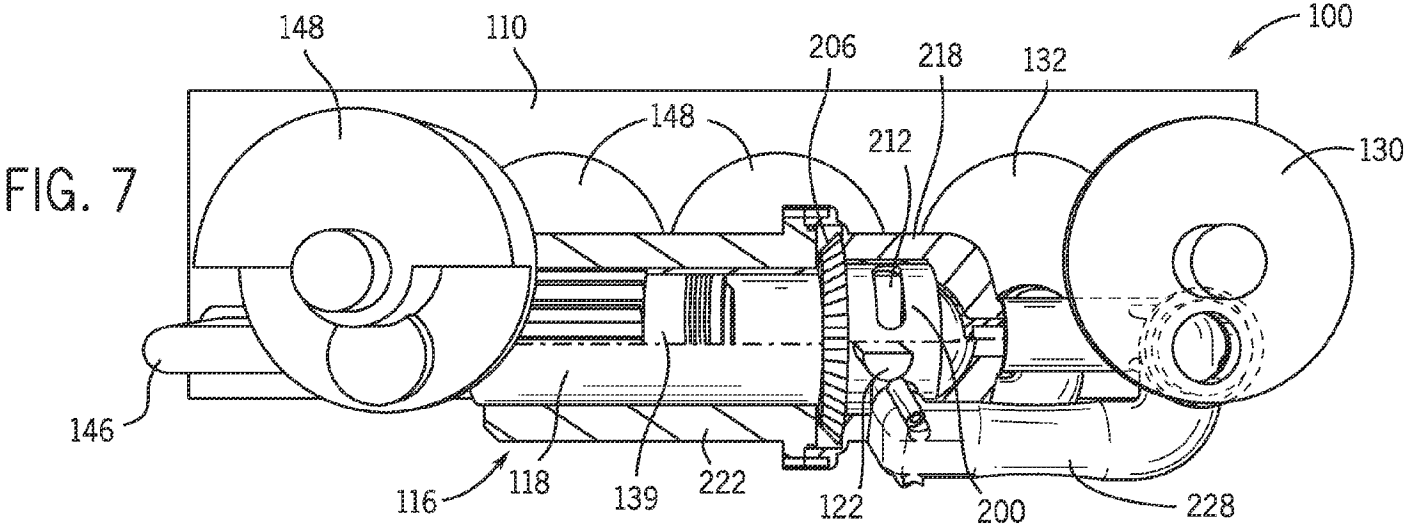
Figure 8:
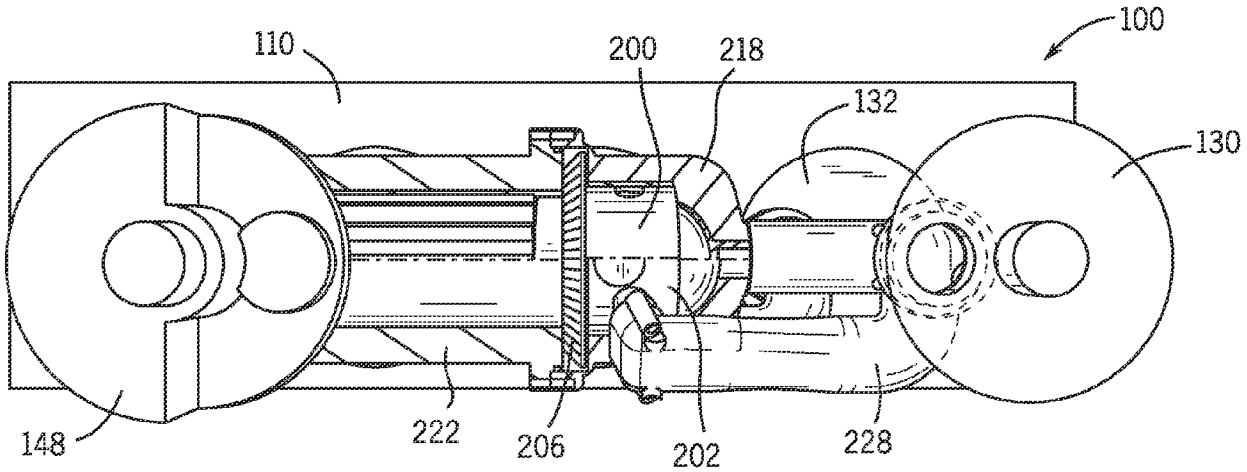
Figure 9:
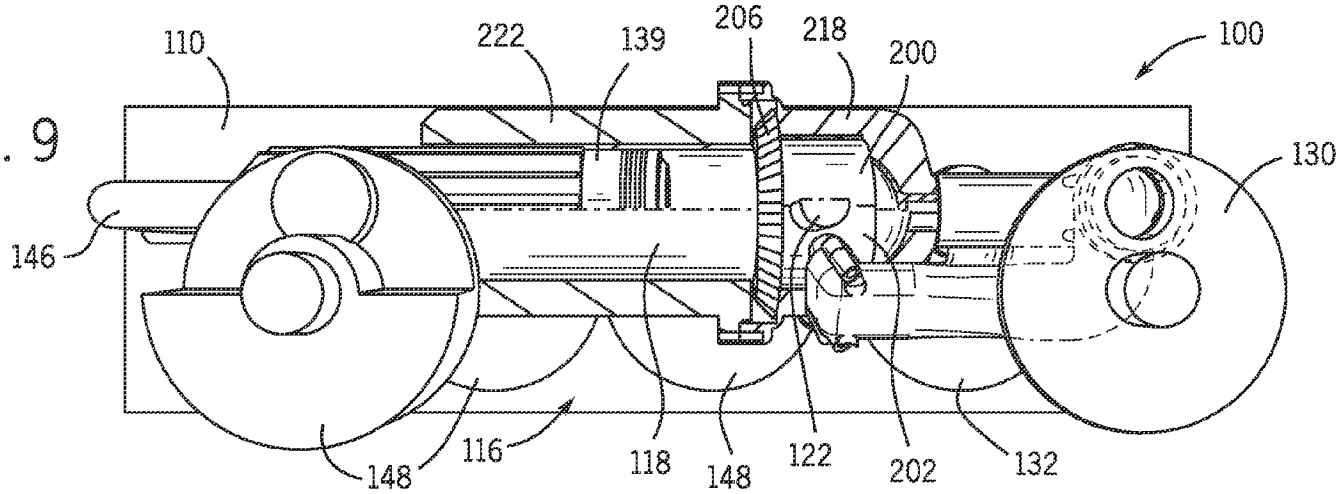
Figure 10:
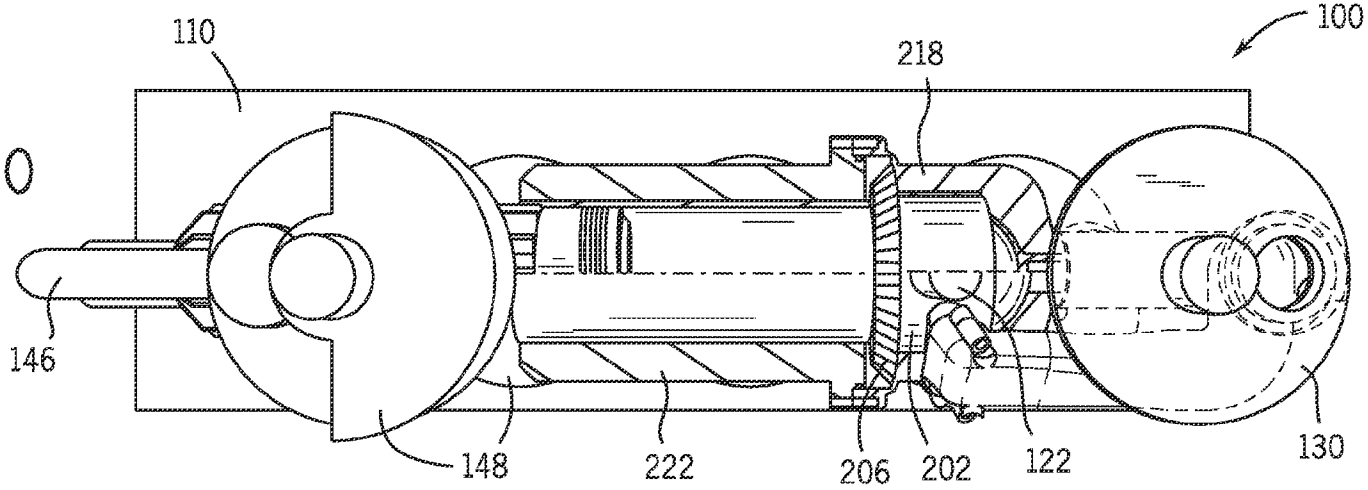
Figure 11:
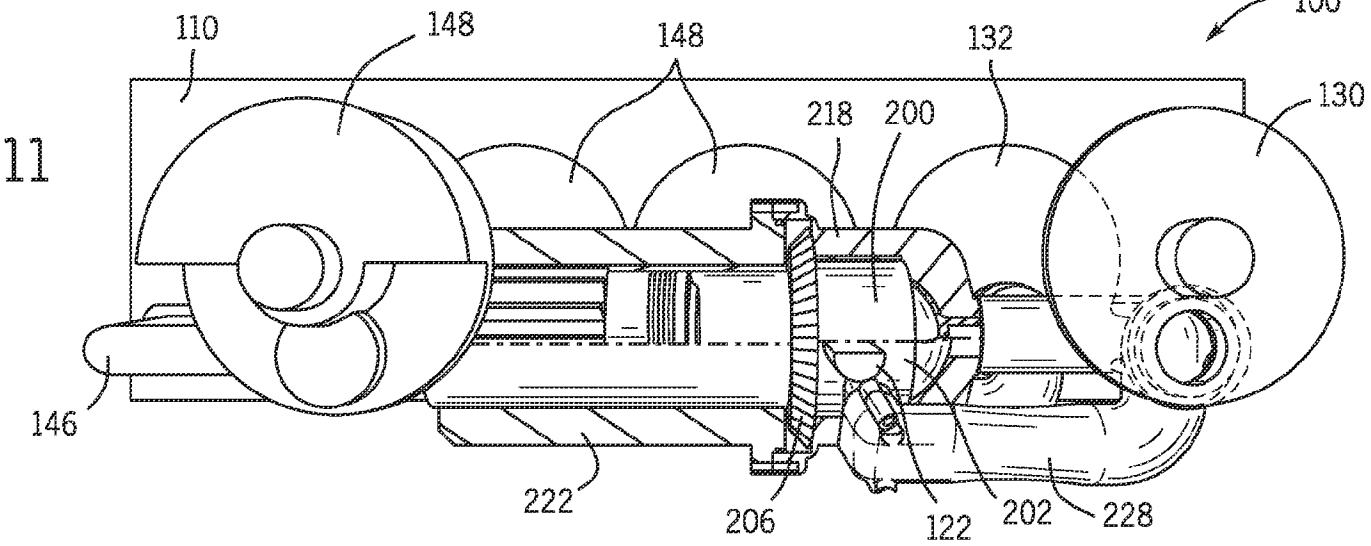
Figure 12:
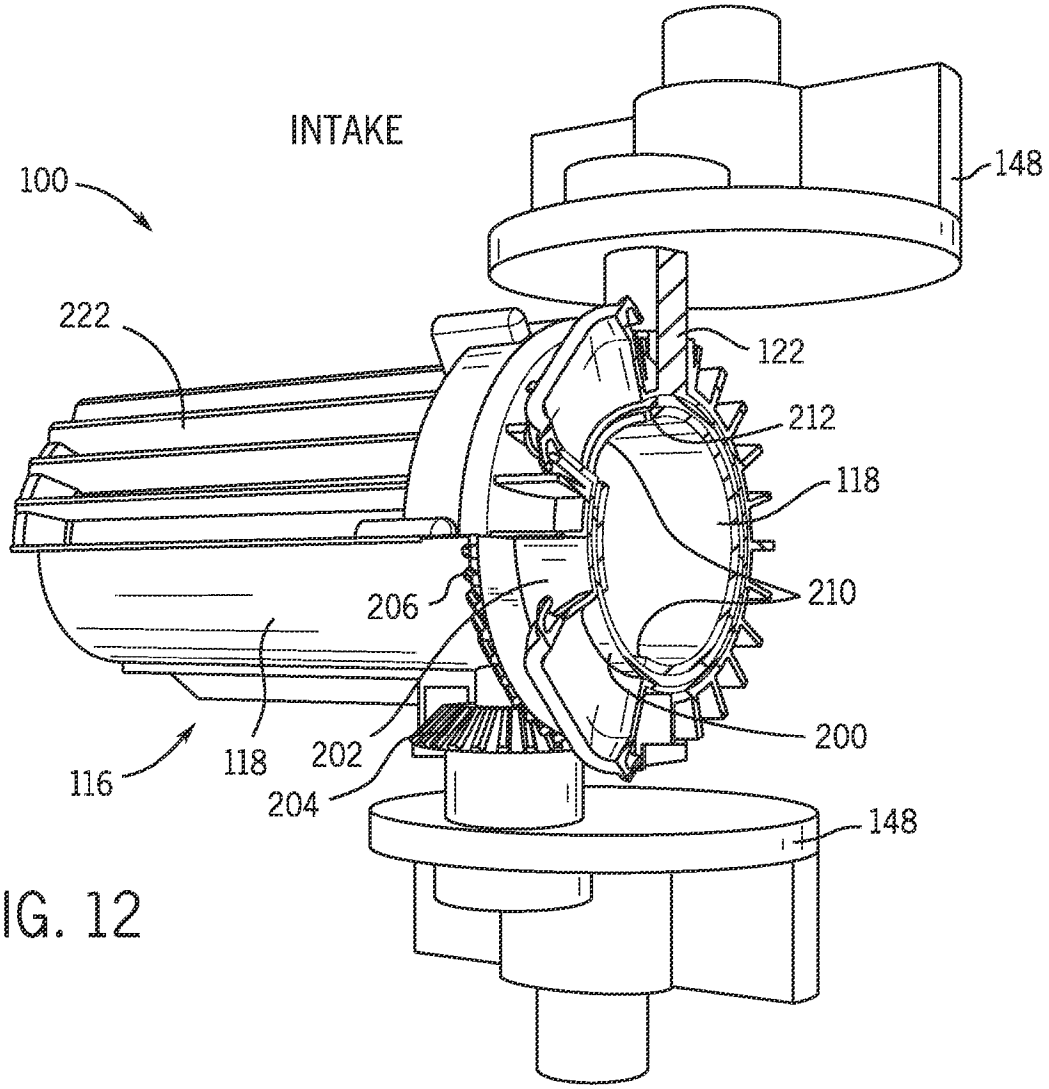
FIGS. 12-19 illustrate the four cycle motions of the sleeve valve around the hollow cylinder during the four cycle combustion operation of the internal combustion engine illustrated in FIG. 1, with each FIGS. 12-19 being a partial, sectional detail view of the hollow cylinder and sleeve valve.
Figure 13:
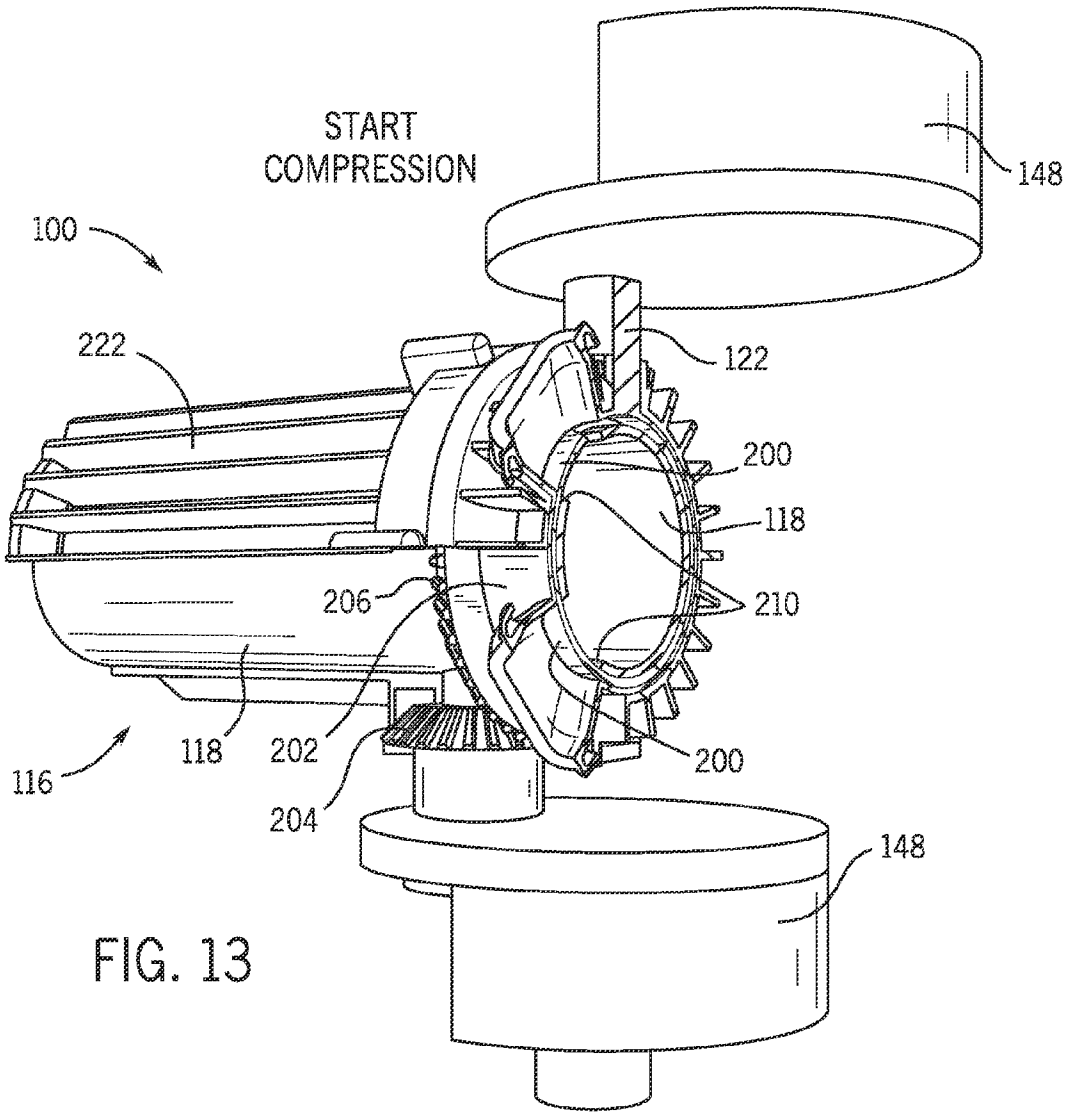
Figure 15:
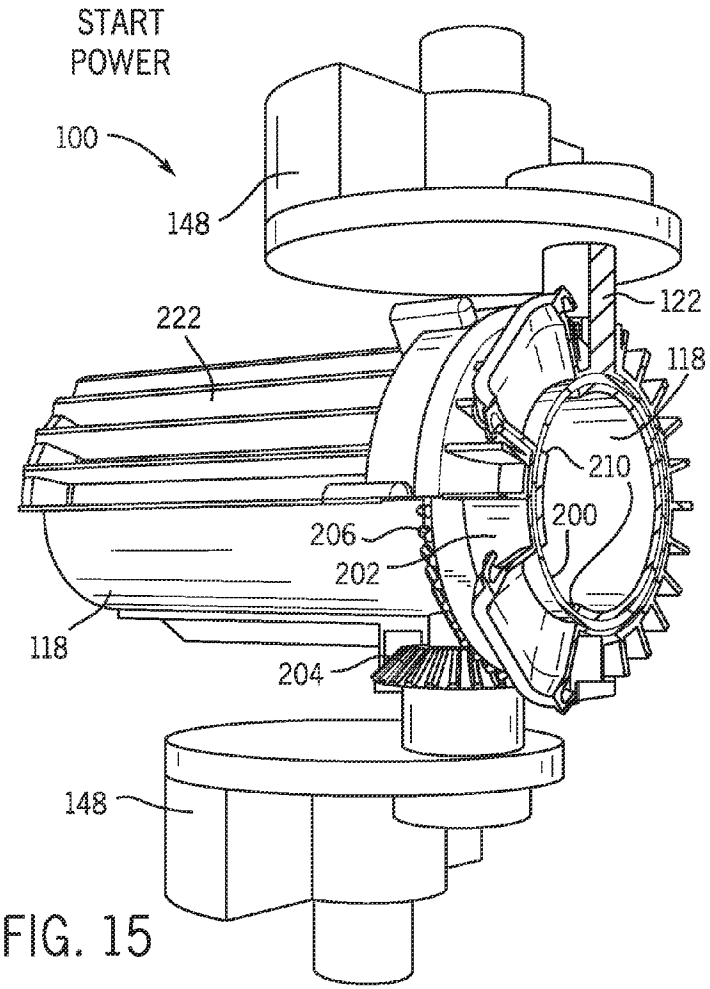
Figure 14:
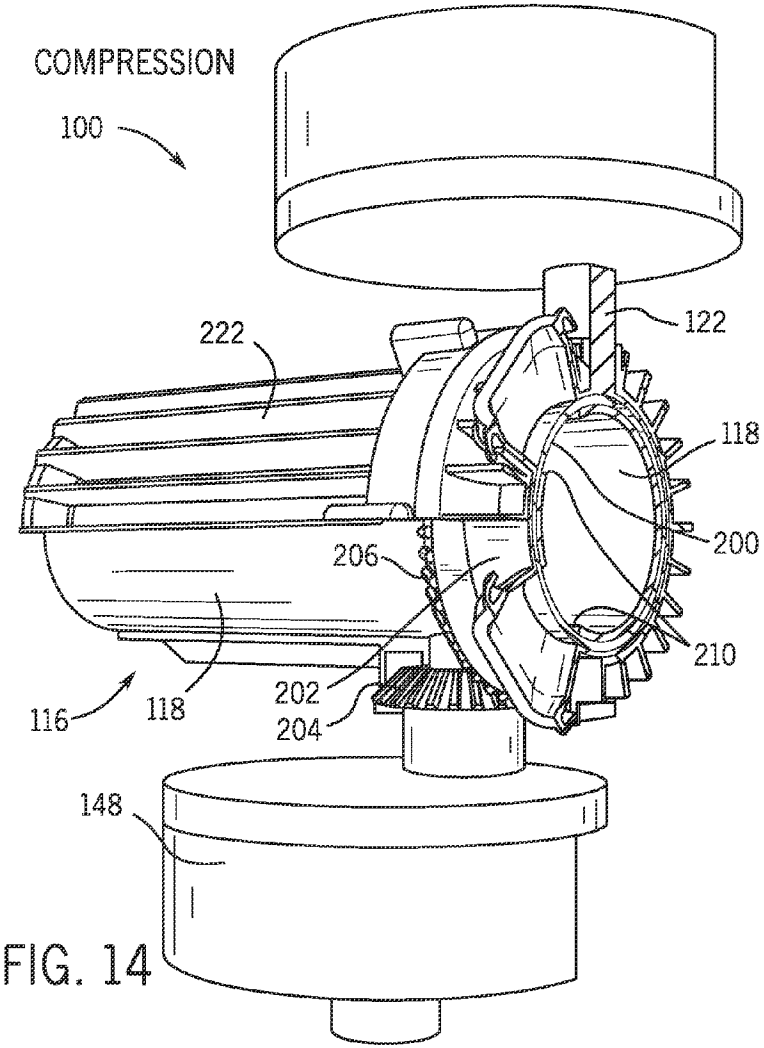
Figure 16:
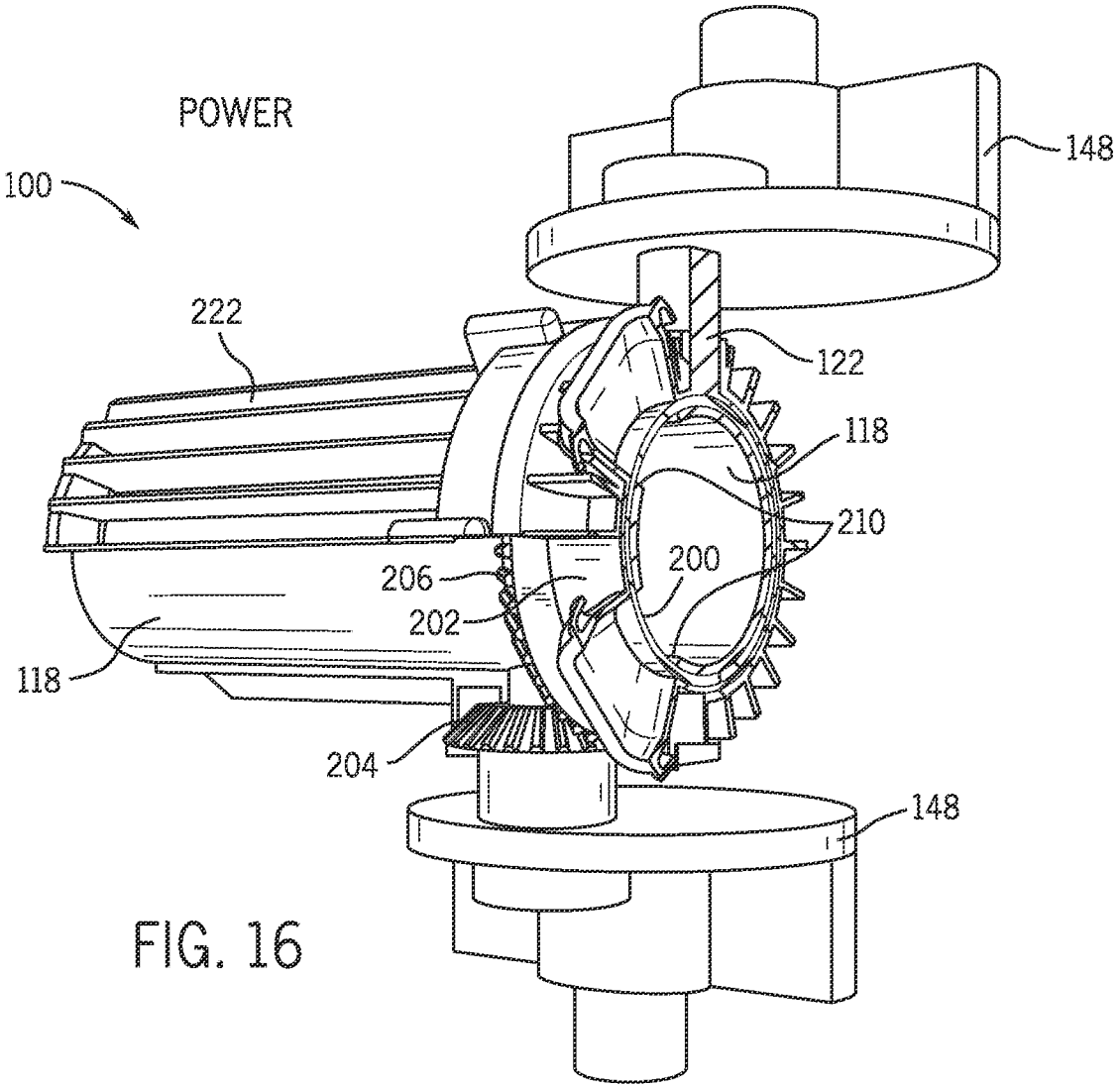
Figure 17:
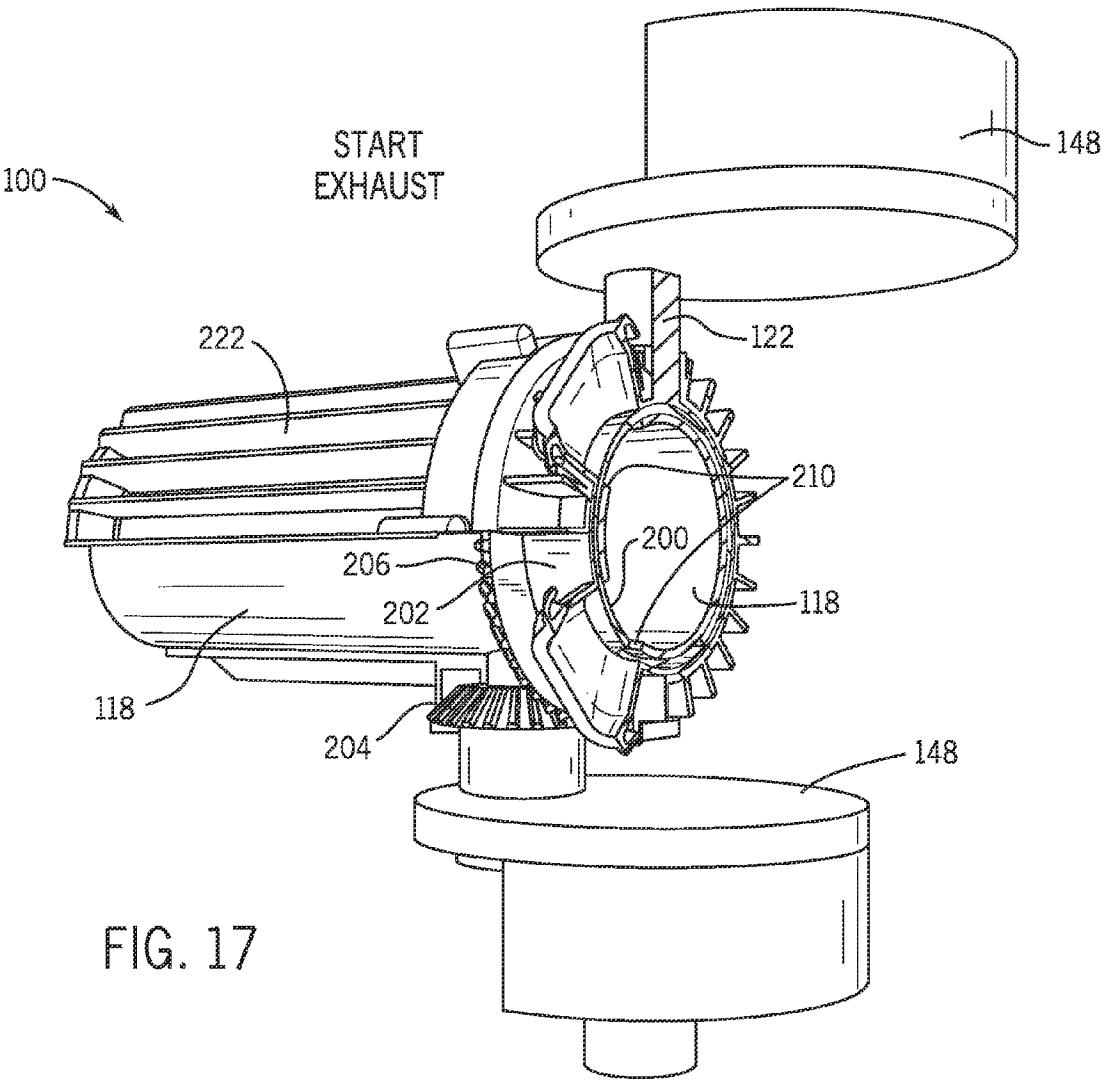
Figure 19:
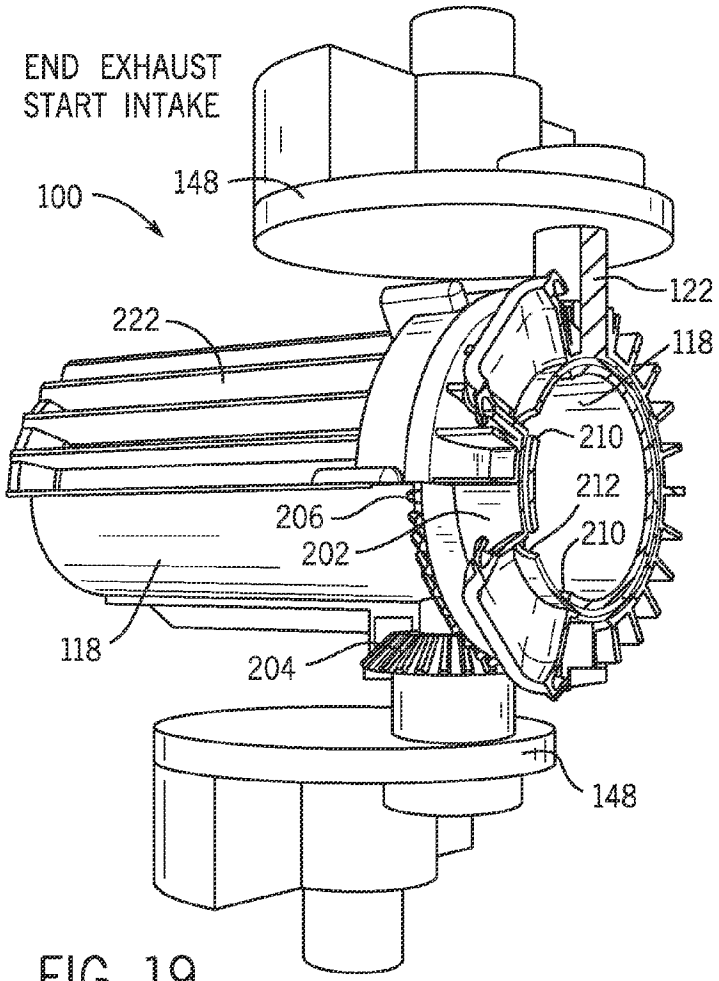
Figure 18:
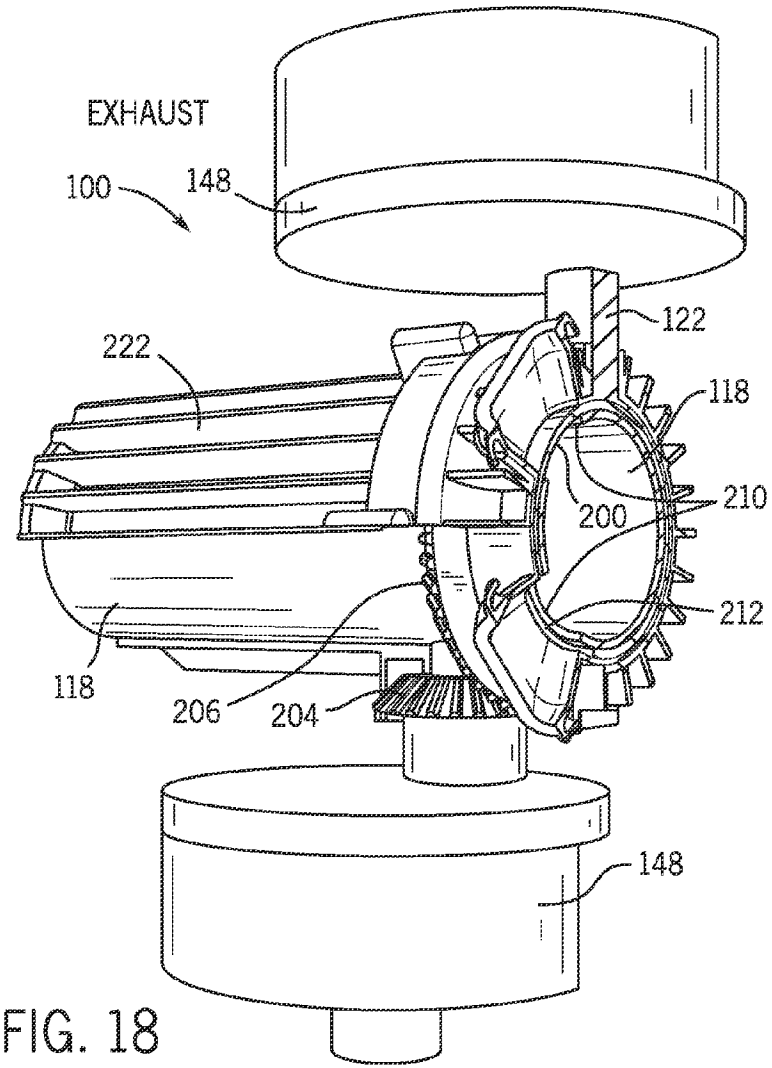

FIGS. 4-19 illustrate, schematically, a four-cycle motion of a combustion cycle of the internal combustion engine 100. The position of the piston unit 138 and cylinder unit 116 during the combustion cycle are illustrated in those figures, as well as the rotation of the sleeve valve 200. FIGS. 4 and 19 illustrate the start of an intake stroke of the piston unit 138 and cylinder unit 116 with FIGS. 5 and 12 illustrating the intake stroke. FIGS. 6 and 13 illustrate the start of a compression stroke with FIGS. 7 and 14 illustrating the compression stroke. FIGS. 8 and 15 illustrate the start of a power stroke and FIGS. 9 and 16 illustrate the power stroke. FIGS. 10 and 17 illustrate the start of an exhaust stroke with FIGS. 11 and 18 illustrating the exhaust stroke. During each of the respective strokes, the rotary sleeve valve 200 rotates about the hollow cylinder 118 and within the cylinder cap 218, opening and closing the cylinder oval ports 210 and the sleeve valve oval port 212 which are aligned with the cylinder cap oval-shaped orifices 220 defined in the cylinder cap 218 which is coupled to the intake/exhaust manifold 228.

It should be understood that the FIGS. 4-19 illustrate approximate positions of the cylinder unit 116, piston unit 138, and sleeve valve 200 during the entire four-cycle compression cycle. Because of the four counter-weighted crankshafts 148 rotating as described above and as illustrated in FIGS. 4 through 19 both the cylinder unit 116 and the piston unit 138 exhibit a simulated reciprocation as the two units rotate about their respective centers-of-gravity 196, 198. Such rotation about the center-of-gravity is illustrated by the side-to-side movement illustrated in FIGS. 5, 7, 9, and 11 of the combustion cycle. The simulated reciprocation of the piston is illustrated in FIGS. 4, 6, 8, and 10 of the combustion cycle.

Figure 21:
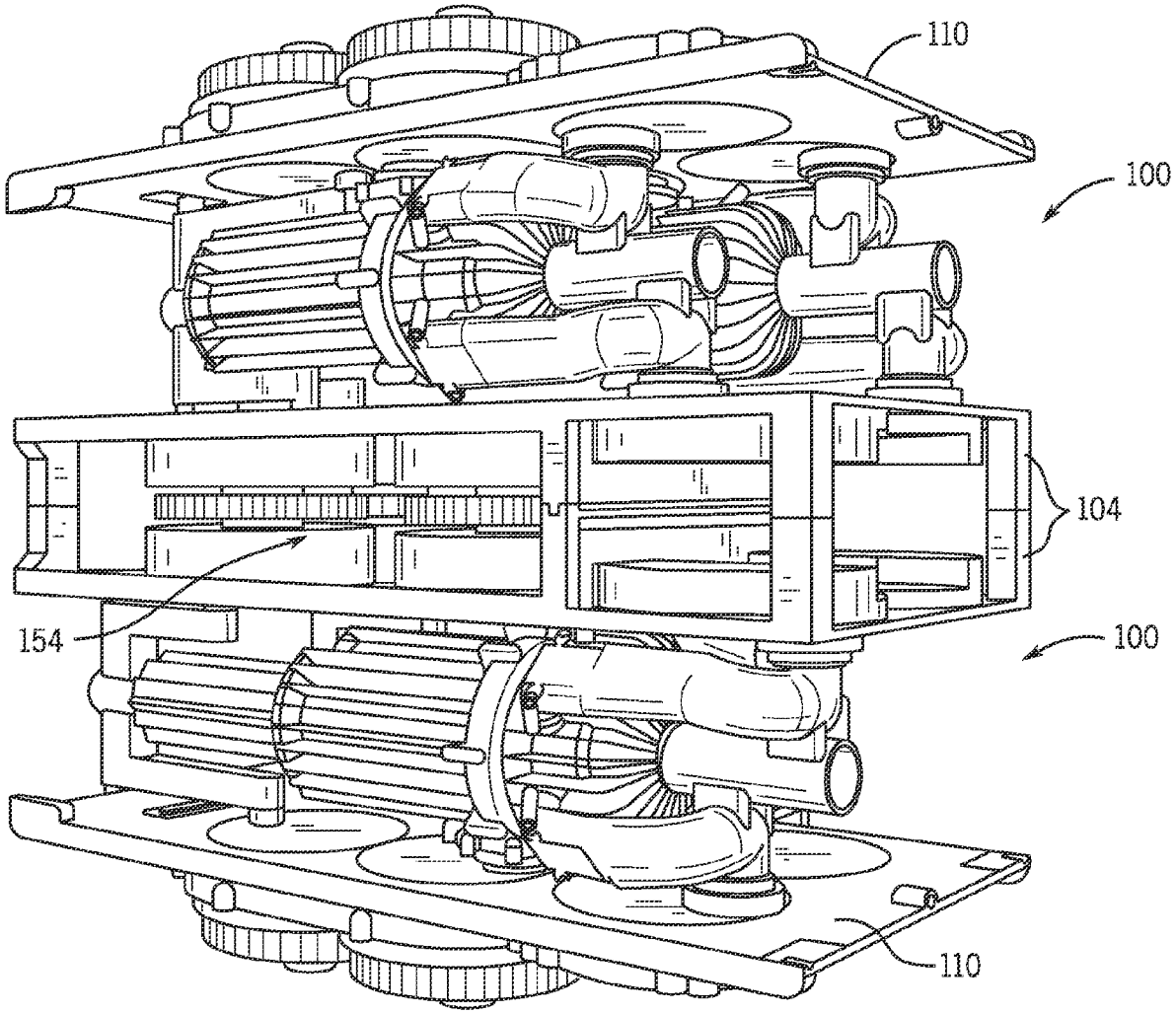
FIG. 21 is a perspective illustration of four of the internal combustion engines illustrated in FIG. 1 coupled together as a four cylinder (four piston units and four cylinder units) engine with a synchronized gear train.

FIG. 21 is an illustration of four of the units built up into a four-cylinder (four piston units 138 and four cylinder units 116) comprising a single engine. The respective units are stacked one on top of another with the synchronized gear train 154 shared by the respective engines.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

Although the foregoing description of the present disclosure has been shown and described with reference to particular embodiments and applications thereof, it has been presented for purposes of illustration and description and is not intended to be exhaustive or to limit the disclosure to the particular embodiments and applications disclosed. It will be apparent to those having ordinary skill in the art that a number of changes, modifications, variations, or alterations to the engine as described herein may be made, none of which depart from the spirit or scope of the present disclosure. The particular embodiments and applications were chosen and described to provide the best illustration of the principles of the engine and its practical application to thereby enable one of ordinary skill in the art to utilize the invention in various embodiments and with various modifications as are suited to the particular use contemplated.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An internal combustion engine comprising: a movable cylinder unit including a hollow cylinder rotatably coupled to a pair of spaced-apart crank shafts with each crankshaft defining a bore receiving a cylinder locating pin coupled to the cylinder unit, the cylinder locating pins aligned on the same horizontal plane off-set from one another, with the cylinder unit movable along a longitudinal axis, the cylinder unit further comprising a sleeve valve, including a cap liner and a beveled pinion gear keyed to one of the crankshafts and in operative engagement with a ring gear coupled to the sleeve valve and rotatively coupled to the cylinder, wherein one cylinder locating pin is coupled to the hollow cylinder and another cylinder locating pin coupled to the cap liner of the sleeve valve; and a moveable piston unit continually disposed within the movable cylinder unit, with the movable piston unit rotatably coupled to a second pair of spaced-apart crank shafts with each crankshaft defining a bore receiving a piston locating pin coupled to the movable piston unit, the piston locating pin aligned on the same horizontal plane off-set from one another, the piston movable along the longitudinal axis in a direction opposite the direction of the cylinder, both the movable cylinder unit and movable piston unit are configured to be balanced relative to the respective center-of-gravity of each unit, with each center-of-gravity located midway between the pair of spaced-apart crank shafts to which each unit is rotatably coupled.

2. The internal combustion engine of claim 1, further comprising a pair of oval ports defined in the cylinder wall, with the oval ports in line with one another and 45° apart, the oval ports configured to selectively align with a single oval port defined in the sleeve valve.

3. The internal combustion engine of claim 1, wherein the ring gear is twice the diameter of the pinion gear with gear teeth defined in each gear engaging and rotating the sleeve valve in a fixed relationship with the cylinder unit.

4. The internal combustion engine of claim 2, wherein the single oval port defined in the sleeve valve and the pair of oval ports defined in the cylinder wall are the same width and each of the three ovals are aligned at the same longitudinal position along the longitudinal axis of the cylinder.

5. The internal combustion engine of claim 2, further comprising a cylinder cap enclosing a portion of the hollow cylinder and the sleeve valve, with the cylinder cap coupled to a cylinder housing enclosing another portion of the hollow cylinder and with the cylinder cap defining two oval-shaped orifices located to align with the pair of oval ports defined in the hollow cylinder.

6. The internal combustion engine of claim 1 wherein the movement of the piston unit and cylinder unit along the longitudinal axis simulates reciprocal motion of the two units and maintains a constant velocity.

7. The internal combustion engine of claim 1, further comprising a fuel supply system coupled to the cylinder unit and an ignition system coupled to the piston unit, with each system coupled to an electronic control unit.

8. The internal combustion engine of claim 7, further comprising a fuel igniter disposed in one of the cylinder unit and piston unit, with the fuel igniter configured to ignite fuel in the cylinder at a predetermined time.

9. The internal combustion engine of claim 7, wherein fuel of the fuel supply system is one of natural gas, diesel oil, and gasoline.

10. The internal combustion engine of claim 8, wherein the fuel igniter is one of a coil and a spark plug.

11. The internal combustion engine of claim 1, further comprising at least one additional piston unit and additional cylinder unit operatively coupled to the other piston unit and cylinder unit.

12. The internal combustion engine of claim 1, further comprising an intake/exhaust manifold coupled to the cylinder unit, the intake/exhaust manifold having an intake side and an exhaust side, wherein the intake side is received in an intake driver of a rotary intake valve, and wherein the exhaust side is received in an exhaust driver of a rotary exhaust valve.

13. An internal combustion engine comprising: a movable cylinder unit including a hollow cylinder rotatably coupled to a pair of spaced-apart crankshafts, with the cylinder unit movable along a longitudinal axis, the cylinder unit further comprising a sleeve valve, including a beveled pinion gear keyed to one of the crankshafts and in operative engagement with a ring gear coupled to the sleeve valve and rotatively coupled to the cylinder; a movable piston unit continually disposed within the hollow cylinder of the cylinder unit, with the piston unit rotatably coupled to a second pair of spaced-apart crankshafts, the piston movable along the longitudinal axis in a direction opposite the direction of the cylinder, both the cylinder unit and piston unit are configured to be balanced relative to the respective center-of-gravity of each unit, with each center-of-gravity located midway between the pair of spaced-apart crankshafts to which each unit is rotatably coupled; further comprising a pair of oval ports defined in the cylinder wait, with the oval ports in line with one another and 45° apart, the oval ports configured to selectively align with a single oval port defined in the sleeve valve; and wherein the single oval port defined in the sleeve valve and the pair of oval ports defined in the cylinder wall are the same width and each of the three ovals are aligned at the same longitudinal position along the longitudinal axis of the cylinder.

14. The internal combustion engine of claim 13, wherein the ring gear is twice the diameter of the pinion gear with gear teeth defined in each gear engaging and rotating the sleeve valve in a fixed relationship with the cylinder unit.

15. The internal combustion engine of claim 13 wherein the movement of the piston unit and cylinder unit along the longitudinal axis simulates reciprocal motion of the two units and maintains a constant velocity.

16. The internal combustion engine of claim 13, further comprising a fuel supply system coupled to the cylinder unit and an ignition system coupled to the piston unit, with each system coupled to an electronic control unit.

17. The internal combustion engine of claim 16, further comprising a fuel igniter disposed in one of the cylinder unit and piston unit, with the fuel igniter configured to ignite fuel in the cylinder at a predetermined time.

18. The internal combustion engine of claim 16, wherein the fuel is one of natural gas, diesel oil, and gasoline.

19. The internal combustion engine of claim 17, wherein the fuel igniter is one of a coil and a spark plug.

20. The internal combustion engine of claim 13, further comprising at least one additional piston unit and additional cylinder unit operatively coupled to the other piston unit and cylinder unit.

21. The internal combustion engine of claim 13, further comprising an intake/exhaust manifold coupled to the cylinder unit, the intake/exhaust manifold having an intake side and an exhaust side, wherein the intake side is received in an intake driver of a rotary intake valve, and wherein the exhaust side is received in an exhaust driver of a rotary exhaust valve.

* * * * *